United States Patent [19]

Hawkes et al.

[11] Patent Number: 4,961,290

[45] Date of Patent: Oct. 9, 1990

[54] MOUNT FOR GRINDING WHEEL

[75] Inventors: John H. Hawkes, Gloucester; John A. MacRae, Lexington, both of Mass.

[73] Assignee: Blanchard Abrasives, Inc., Marysville, Wash.

[21] Appl. No.: 777,217

[22] Filed: Sep. 18, 1985

Related U.S. Application Data

[63] Continuation-in-part of Ser. No. 457,679, Jan. 13, 1983, abandoned.

[51] Int. Cl.[5] ..... B24D 7/06

[52] U.S. Cl. ..... 51/209 R; 51/206.5

[58] Field of Search ..... 51/209 R, 209 S, 209 DL, 51/206.4, 206.5, 204, 177, 180, 402, 406, 207, 263, 211 R; 206/621, 586, 592, 349

[56] References Cited

U.S. PATENT DOCUMENTS

| | | | |
|---|---|---|---|
| 1,611,747 | 12/1926 | Heppenstall | 51/209 R |
| 2,078,120 | 4/1937 | Beth | 51/209 R |
| 2,453,748 | 11/1948 | Fisher et al. | 51/209 R |
| 3,171,237 | 3/1965 | Howard | 51/209 R |
| 4,212,137 | 7/1980 | Rue | 51/206.4 |

*Primary Examiner*—Robert A. Rose

*Attorney, Agent, or Firm*—Seed and Berry

[57] ABSTRACT

A system for mounting the abrasive grinding members of a segmented grinding wheel in the chuck of a rotary surface grinder. A cushioning member is disposed about an end of each segment and extends laterally along its end surfaces. Clamps for holding the segments in place in the chuck bear upon the covering which may be a sleeve or cap which cushions the grinding segments from the force of the clamps and from possibly damaging contact with the chuck.

4 Claims, 1 Drawing Sheet

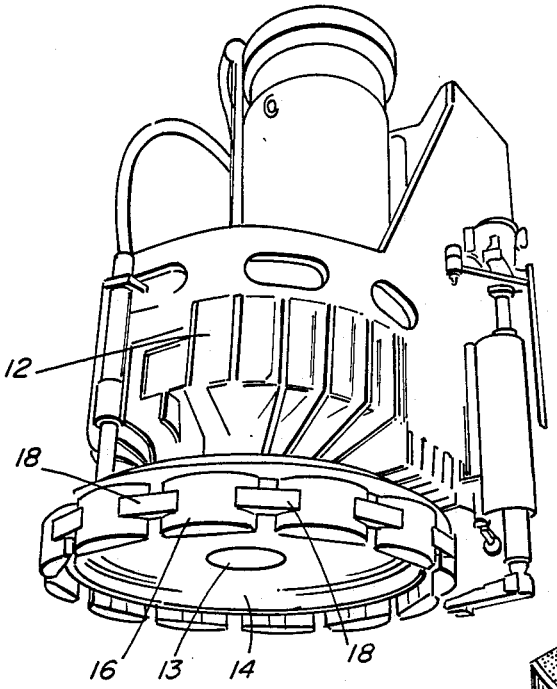
FIG. 1
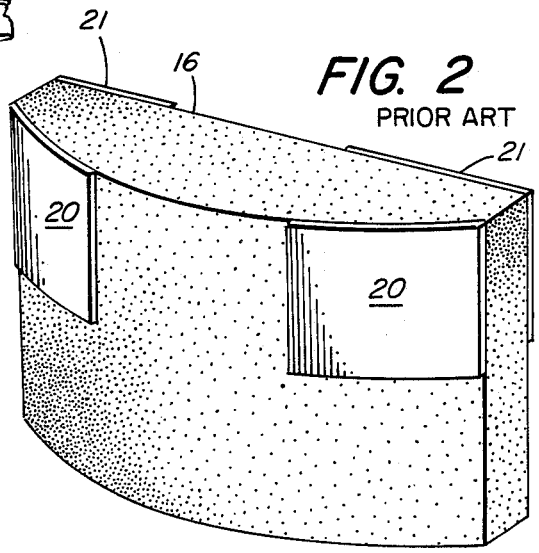
FIG. 2
PRIOR ART
FIG. 3
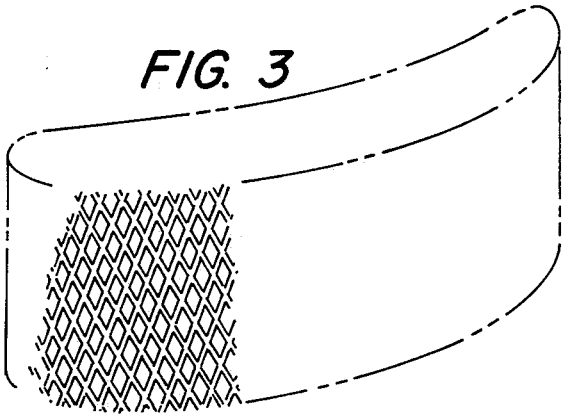
FIG. 4
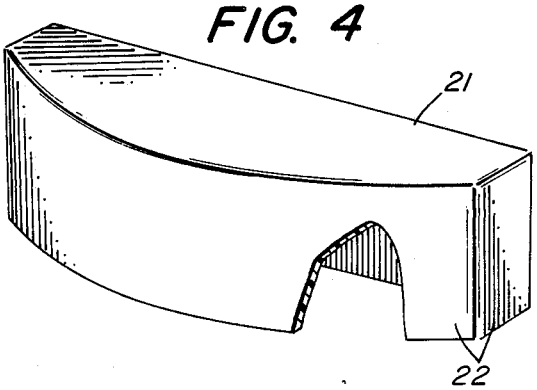

MOUNT FOR GRINDING WHEEL

BACKGROUND OF THE INVENTION

This is a continuation-in-part of U.S. Pat. Application Serial No. 457,679 filed Jan. 13, 1983, now abandoned.

The invention relates to rotary surface grinders and more particularly to a mounting system for the abrasive segments of a segmented rotary grinding wheel. In a rotary surface grinder, the grinding wheel used to grind the surface of a workpiece or workpieces can be a solid continuous cylinder or a circular assembly of a number of abrasive segments of generally arcuate shape. The segments are assembled and interconnected so as to form a generally cylindrical grinding element leaving a flat end face which is mounted in the chuck of the grinder. Each segment must be tightly secured and held in place relative to other segments to maintain the flat end face and generally cylindrical configuration, no part of which should loosen or shift during grinding operations.

Typically, grinding wheels and segments are composed of bonded abrasive particles of aluminum oxide or silicon carbide ranging in hardness. In some instances, mixtures of those and similar abrasives are bonded together by conventional techniques such as vitrified silicate or resinoid bonds. To hold assembled segments together properly, it is necessary to use some form of clamping device and the segments would be subject to damage if the clamping members were in direct contact with the surfaces of the segments.

To avoid such damage and yet to securely mount the segments, it has been the practice to cement individual pads of an organic gasket material such as Vellumoid ® onto the surfaces of each segment. These pads are generally four in number and serve to cushion the contact between the clamps and the segments as well as between the segments and the chuck. Although the basic protective cushioning function is served by the individual pads, other problems remain. For example, the cement joint between one or more of the pads and the segment is subject to failure during the grinding operation. Such failure of a cement joint frequently causes loss of proper mounting of the segment and production must stop to permit correction.

Another problem encountered with Vellumoid pads is their tendency to trap the coolant sludge around the clamp areas and that may interfere with precision grinding. One further problem is that as a segment is ground down to the point where the pads are located, the pads do not wear off in fine particles as the abrasive segment does, but rather, break off in relatively large pieces. These pieces can clog the coolant system, again causing interference with production because of machine downtime while corrective measures are taken.

A further serious disadvantage of the use of individually glued pads is the amount of time necessary for the gluing operation. The time-consuming gluing operation increases the cost of the abrasive segment. Another costly technique involves injection molding of a plastic casing around an abrasive element. Not only is this technique costly, but since the plastic casing virtually completely surrounds the element, the plastic casing material will be abraded away along with the abrasive material and the plastic oftentimes clogs the cooling system.

It is therefore an object of the present invention to eliminate the above-mentioned cost and other problems associated with the use of a plurality of individual pads which must be individually cemented in place.

It is a further object of the invention to provide cushioning between the clamp and the abrasive element without the need for a separate molding operation.

It is yet another object of the invention to provide cushioning between the segments and the clamps which can be applied to the abrasive segments at a high throughput rate.

SUMMARY OF THE INVENTION

In the present invention, the above-mentioned difficulties associated with the prior art methods of mounting segments of a rotary grinding wheel are avoided by the provision of continuous cushioning interfaces between the segments and the clamps and between the segments and the chuck of the grinding wheel. Instead of separated individual pads, a sleeve or cap including depending flaps is slidingly fitted over an end of each segment so that the clamps bear upon the flaps. The sleeve is readily removable from the abrasive segment.

The material from which the sleeves or caps are made is preferably one which will not soften or absorb fluid from conventional coolants used in grinding and which will wear off in small particles.

BRIEF DESCRIPTION OF THE DRAWINGS

FIG. 1 is a perspective view showing a typical mounting of a segmented grinding wheel in the head of a rotary surface grinder;

FIG. 2 is a perspective view of a prior art mounting system using Vellumoid gasket pads; and FIG. 3 is a perspective view of one preferred form of the present invention.

DETAILED DESCRIPTION OF THE PREFERRED EMBODIMENT

In FIG. 1, some illustrative background of the environment for utilization of the present invention is provided. Specifically, there is shown in perspective the upper portion of a rotary surface grinder which includes a wheel head 12 having a spindle 13. Mounted on the spindle 13 is a segment chuck which includes an internal sleeve 14 against which grinding segments such as that shown at 16 are tightly held by clamps such as that at 18. Such chucks are well-known in the machine tool industry, one in particular being sold under the name of a "Cortland Chuck".

A single segment 16 prepared for mounting as in the prior art is shown in FIG. 2. There may be seen cemented to the curved outer surface adjacent the top of the segment 16 two individual pads 20 of organic gasket material such as Vellumoid. It is these pads against which the clamps 18 bear to hold the segments in position, as illustrated in FIG. 1. As is obvious from FIG. 1, each clamp bridges two adjacent segments, bolts passing through the clamps and between segments to be threadably tightened in the internal sleeve 14. Two additional pads 21, the top edges of which are visible in FIG. 2, are juxtaposed opposite the pads 20 and cemented to the back surface of each segment to provide cushioning between the segment and the sleeve 14 against which the segments are pressed by the action of the clamps.

Although the installation of such pads would appear to be a relatively simple operation, there is some difficulty and time consumed in firmly cementing the four pads in their proper locations. Exact placement and the obtaining of a good bond pose in-house manufacturing problems which contribute appreciably to costs.

The employment of pads of organic gasket material, of which Vellumoid is a typical product, also gives rise to problems in the field. First, the cement joint which holds the pads in place is a common source of trouble. Those portions of a pad which are not held in place by the clamps when a cement bond fails tend to fly off and can cause problems which require the machine to be shut down while matters are rectified. Delamination of the pads also occurs and causes problems very similar to those arising when the cement joint fails. In this case as well, correction of the problem requires machine down-time.

Still another consideration is the thickness of the Vellumoid pads. Because the pads are compressible, the clamp bolts must be retracted an appreciable amount to clear the total uncompressed thickness and then tightened to compress the pads sufficiently to assure a tight grip on the segments. The operation of retracting and tightening the clamp bolts when installing or replacing segments is again time-consuming and costly in terms of machine down-time.

Finally, the Vellumoid pads tend to soften when exposed to the coolants which are required in grinding operations. When such softening occurs, it becomes necessary to retighten the clamp bolts to maintain clamping pressure and proper grinding operation.

Referring to FIG. 3, one preferred mounting system for the abrasive segments used in a rotary grinding system made in accordance with the present invention is shown.

Instead of a set of four pads of gasket material individually cemented to an abrasive segment as shown in the prior art of FIG. 2, a sleeve or cap 22 is molded from low density polyethylene or polypropylene. The cap 22 includes depending front flaps 24 and 26 and depending rear flaps 28 and 30. The cap 22 is configured so that when the cap is slidingly fitted upon an abrasive element, the depending flaps will assume positions roughly corresponding to the individual pads shown in FIG. 2.

Since the cap 22 readily slides onto an abrasive segment, manufacturing time is substantially less than the time it takes to cement four Vellumoid pads onto a segment. In particular, it has been found that the caps 22 may be fitted onto the abrasive elements at a rate of approximately 200 per hour in contrast to the approximately 200 per 8 hour shift for the individually cemented pads. A filler of fine crushed glass or calcined materials may be incorporated in the molding composition to raise the coefficient of friction between an abrasive segment and the cap 22 under clamping pressure. The inclusion of such a filler does not interfere with the sliding operation during fitting of the cap. It should also be noted that a cap, once installed on an abrasive segment, may be readily removed if necessary.

Another important feature of the present invention will now be described, still in conjunction with FIG. 3. During the grinding operation, an abrasive element is continually worn away. After substantial wear, the clamps holding the abrasive element assemblies in place are released allowing the element to drop downwardly for more complete utilization of the abrasive element. A spacer is generally placed on top of the cap 22 and the element reclamped in the chuck. Score lines 32 and 34 are molded into the cap 22 to allow the depending flaps 24 and 26 to be removed after the abrasive element has been lowered. Removing the flaps 32 and 34 eliminates their contacting the workpiece during grinding.

A further advantage of the present invention is that the overall cross-sectional thickness of the covered segment is less than that of a segment with juxtaposed Vellumoid pads. As a result, less retraction of the clamp bolts is required to grip the segment. A still further advantage of the invention is that retraction and positive tightening of bolts is immediate, no compression occurring as with the Vellumoid pads. This latter feature provides a further benefit of time-saving when changing segments. Furthermore, because they do not absorb liquid as Vellumoid does, a plastic sleeve or cap will not soften from contact with the system coolant. Consequently, during grinding operations, clamping pressure remains constant.

Various changes can be made in the preferred embodiments without departing from the scope of the invention.

What is claimed is:

1. In a rotary grinder having a plurality of non-interlocking abrasive segments each held adjacent one another in a chuck by clamps between adjacent segments to form a substantially circular grinding wheel, the improvement comprising a flexible plastic cap slidably received over one end of each of said segments, each of said caps being molded independently of said segments and having a depending peripheral portion providing a close sliding fit with the exterior surface of each of said segments adjacent said one end, and flap means integral with and depending from each of said peripheral portions and also having a close sliding fit with said exterior surface thereof, each of said clamps bearing upon the flap means of two adjacent segments and holding said segments in predetermined positions in said chuck, said exterior surface of said segments otherwise being left uncovered by said cap.

2. In a rotary grinder as defined in claim 7, the combination wherein said exterior surface includes front and back surfaces to which said flap means have a close sliding fit.

3. In a rotary grinder as defined in claim 2, the combination wherein each of the depending flap means is provided with separating means to allow the flaps to be removed.

4. In a rotary grinder as defined in claim 2, the combination wherein each of said plastic caps is molded of a plastic chosen from the group which includes low density polyethylene and polypropylene.

* * * * *

UNITED STATES PATENT AND TRADEMARK OFFICE

CERTIFICATE OF CORRECTION

PATENT NO. : 4,961,290

DATED : October 9, 1990

INVENTOR(S) : John H. Hawkes; John A. MacRae

It is certified that error appears in the above-identified patent and that said Letters Patent is hereby corrected as shown below:

In claim 2, column 4, line 48, please delete "7" and substitute therefor --1--.

Signed and Sealed this

Seventeenth Day of March, 1992

*Attest:*

HARRY F. MANBECK, JR.

*Attesting Officer*

*Commissioner of Patents and Trademarks*